United States Patent [19]

Keys

[11] 4,327,608

[45] May 4, 1982

[54] HAND-HELD JEWELER'S CLAMP

[76] Inventor: C. Brant Keys, P.O. Box 767, North Palm Springs, Calif. 92258

[21] Appl. No.: 162,099

[22] Filed: Jun. 23, 1980

[51] Int. Cl.[3] ..... B25B 5/04

[52] U.S. Cl. ..... 81/4; 269/3; 269/6; 269/234; 269/238; 269/909

[58] Field of Search ..... 269/6, 234, 909, 237, 269/238, 3; 81/4, 6–8; 29/261, 262, 265, 268; 24/251, 249 LS, 248 SA, 248 GC, 248 SB, 248 R, 248 F, 132 HA

[56] References Cited

U.S. PATENT DOCUMENTS

| | | | |
|---|---|---|---|
| 14,795 | 5/1856 | Buss | 269/6 |
| 57,977 | 9/1866 | Sanborn | 24/248 SB |
| 166,553 | 8/1875 | Pollard | 269/234 |
| 327,558 | 10/1885 | Kuder | 81/4 |
| 542,402 | 7/1895 | Anzelewitz | 81/4 |
| 941,832 | 11/1909 | Widmann | 81/4 |
| 1,532,510 | 4/1925 | Mathews | 24/248 F |
| 2,261,005 | 10/1941 | Thompson et al. | 24/248 GC |
| 2,269,790 | 1/1942 | Sherril | 24/249 LS |
| 3,096,551 | 7/1963 | Shoberg | 24/132 HA |
| 3,778,868 | 12/1973 | Kelly | 24/132 R |
| 4,171,800 | 10/1979 | Weaver | 81/4 X |

*Primary Examiner*—Robert C. Watson
*Attorney, Agent, or Firm*—Herbert E. Kidder

[57] ABSTRACT

A hand-held vise for use by jewelers or the like comprising a pair of clamp members having jaws at one end, a fulcrum pin extending transversely between and intermediate the ends of such clamp members, and a ring surrounding the clamp members to constrain the latter to pivot about a fulcrum pin. A screw-threaded rod is connected to the fulcrum pin, and extends rearwardly therefrom between the clamp members in the direction away from the jaws. Screwed onto this rod is a handle having a tapered formation at one end engageable with the adjacent ends of the clamp member to effect a clamping action of the jaws on a workpiece.

1 Claim, 4 Drawing Figures

FIG. 1.
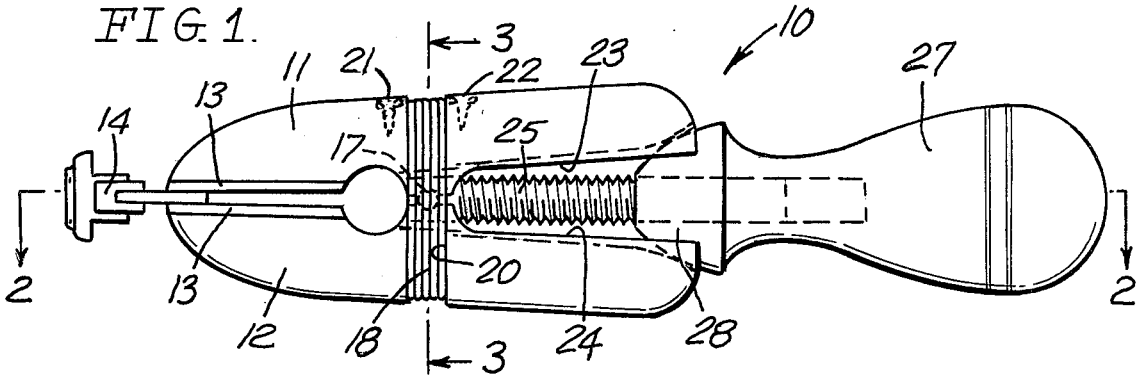
FIG. 2.
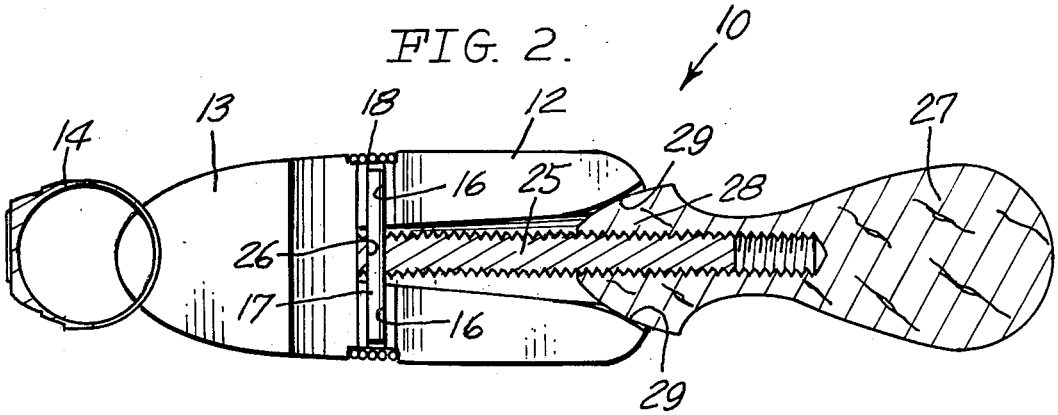
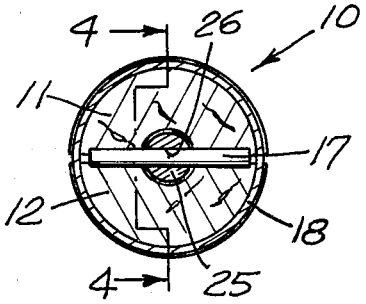
FIG. 3.
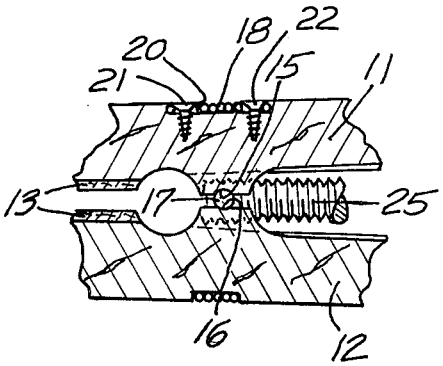
FIG. 4.

HAND-HELD JEWELER'S CLAMP

CROSS-REFERENCE TO RELATED APPLICATIONS

This application is a substitute for abandoned application Ser. No. 623,794, filed Oct. 20, 1975.

BACKGROUND OF THE INVENTION

This invention relates to clamping vises and has particular reference to a hand-held vise of the type used by jewelers or the like to clamp or hold items such as rings to be worked on.

Hand-held vises of this type have been in extensive use heretofore. Such vises generally comprise two clamp members pivotally connected intermediate the ends thereof by suitable bearings and having jaws at one end. Since the jaws must normally exert considerable force to effectively clamp jewelry and other items to be worked on, a wedge is generally driven between the opposite ends of the clamp members. This creates considerable loads on the hinge elements or bearings, and since the latter must be relatively small to be located between or alongside the clamp members, such hinge bearings often break. Further, in order to make the hinge bearings as large as possible, they often project along the sides of clamp members, making it inconvenient to hold the same in one's hand. Another disadvantage of these prior vises is that the wedge tends to loosen during the time that the piece of jewelry is being worked on, and must, from time to time, be hammered down into the space between the clamp members, so as to retighten the grip on the workpiece.

SUMMARY OF THE INVENTION

The primary object of the present invention is to provide an improved jeweler's clamp that is extremely easy and convenient to use, with a positive, non-slip clamping action, and means for accurately adjusting the clamping face to provide the precise grip on the workpiece desired by the user.

Another object of the invention is to provide a jeweler's clamp having a new and unique form of pivotal connection between the clamping members, which is simple and compact, while at the same time having great strength to withstand the forces acting upon it.

Other objects and advantages of the invention will become apparent to those skilled in the art from the following detailed description of the preferred embodiment thereof, with reference to the accompanying drawings.

DESCRIPTION OF THE DRAWINGS

FIG. 1 is a side view of a hand-held jeweler's clamp embodying the preferred form of the present invention;

FIG. 2 is a longitudinal sectional view through the clamp, taken along line 2—2 of FIG. 1;

FIG. 3 is a transverse sectional view, taken along line 3—3 of FIG. 1; and FIG. 4 is a fragmentary sectional view taken substantially along line 4—4 of FIG. 3.

DESCRIPTION OF THE PREFERRED EMBODIMENT

In the drawings, the jeweler's clamp of the present invention is designated in its entirety by the reference numeral 10, and comprises a pair of similar clamp members 11 and 12 located in side-by-side relation and constructed of wood, plastic, or metal. The members 11 and 12 are smoothly rounded along their lengths, and at their ends, as seen in the drawings, to enable the same to be comfortably held in the hand.

The left-hand ends of the clamp members 11, 12 form opposed jaws, and their inner sides are faced with inserts 13 of leather or other relatively soft material, so that they may clamp firmly against an item, such as a ring 14, without damaging the latter.

Semicircular bearing surfaces 15 and 16 are formed in the members 11 and 12, respectively, intermediate the ends thereof, to pivotally fit against opposite sides of a fulcrum pin 17. The clamp members are held against the pin 17 in pivotal engagement therewith by a ring member 18 which is fitted within a shallow annular groove 20 formed circumferentially around the clamp members. The ring 18 is preferably formed of several windings of metal wire having a relatively high tensile strength, the said wire windings being laid side-by-side in groove 20 in a position surrounding or in register with the rod 17, with the ends of the wire anchored to screws 21 and 22 on opposite sides of the groove. Thus, the fulcrum pin 17 forms a cylindrical male formation that is pivotally received in the bearings 15 which comprise opposed femal semi-cylindrical formations.

The right-hand ends of the clamp members 11 and 12 are relieved at 23 and 24, respectively, along their inner facing sides. A screw-threaded rod 25 extends axially of the clamp members and between such relieved sections 23 and 24, and has a transversely extending hole 26 formed therein which loosely receives the fulcrum pin 17.

A rounded handle 27 is threaded over the right-hand end of rod 25 and has a rounded conical wedging formation 28 thereon engaging with mating concave formations 29 formed in the clamping members 11 and 12.

Since the cut-out sections 24 and 23 of the clamp members are normally spaced apart from threaded rod 25, the latter is free to pivot or "float" somewhat, so that the wedging conical formation 28 may properly seat within the mating concave socket portions 29.

In operation, the workpiece 14 is placed between the jaws of the clamp members 11 and 12, and the handle 27 is turned to spread the right-hand ends of the clamp members apart, causing the clamp members to pivot about fulcrum pin 17, forcing the jaw inserts 13 to grip the workpiece. During the clamping operation, the actual reactive force is borne by the wire windings 18 and since this force produces a tensile stress in the wire, the latter can easily withstand the same without breaking. The reactive force tending to separate the members 11, 12 when the clamp is screwed up tight, is resisted by all of the wire windings, and there is no localized weakening, as when a band of metal has holes drilled through opposite sides thereof to receive pivot pins. The result is that the wire windings 18 provide extremely powerful connection for holding the two clamping members together against opposite sides of the fulcrum pin 17.

Since the wire windings 18 surround the fulcrum pin 17, they retain the pin in place endwise and also hold the members 11 and 12 together. Also, it will be noted that the wire windings 18 present a substantially unbroken surface with the clamp members, without any projections which would otherwise render the vise inconvenient or uncomfortable to hold in one's hand.

While I have shown and described in considerable detail what I believe to be the preferred form of my invention, it will be understood by those skilled in the art that the invention is not limited to such details, but may take various other forms within the scope of the claims.

What I claim is:

1. A vise for clamping jewelry items or the like, comprising:

a pair of facing clamp members forming jaws at one end thereof;

pivot means between the facing portions of said members intermediate the ends of said members, said pivot means comprising concave, semi-cylindrical bearing surfaces formed in and extending across each of said members, and a cylindrical fulcrum pin extending transversely between said members and seated within said bearing surfaces, said bearing surfaces on said clamping members bearing against opposite sides of said fulcrum pin;

a ring snugly surrounding said clamp members directly over said pivot means so as to unyieldingly hold the clamping members together, with said semi-cylindrical bearing surfaces pressed against the fulcrum pin;

said ring comprising a plurality of windings of high-tensile-strength wire; said clamp members having a shallow annular groove formed in the outer surfaces thereof surrounding said fulcrum pin, in which said wire windings are laid; and the ends of said wire being anchored to one of said clamp members; and adjustable spreading means operable to spread the ends of said clamp members opposite said jaws.

* * * * *